US008098216B2

(12) United States Patent
Park et al.

(10) Patent No.: US 8,098,216 B2
(45) Date of Patent: Jan. 17, 2012

(54) PLASMA DISPLAY APPARATUS AND DRIVING METHOD THEREOF

(75) Inventors: Kirack Park, Gyeongsangbuk-do (KR); Seonghwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 767 days.

(21) Appl. No.: 11/425,253

(22) Filed: Jun. 20, 2006

(65) Prior Publication Data

US 2007/0210990 A1 Sep. 13, 2007

(30) Foreign Application Priority Data

Mar. 8, 2006 (KR) ..... 10-2006-0021960

(51) Int. Cl.
*G09G 3/28* (2006.01)

(52) U.S. Cl. ..... 345/60; 345/63

(58) Field of Classification Search ..... 345/60–68
See application file for complete search history.

(56) References Cited

U.S. PATENT DOCUMENTS

2005/0073485 A1* 4/2005 Kim et al. ..... 345/63
2005/0243027 A1* 11/2005 Chung et al. ..... 345/60

FOREIGN PATENT DOCUMENTS

CN 1287654 A 3/2001
CN 1677462 A 10/2005
KR 10-2005-0071203 7/2005
KR 10-2005-0092597 9/2005

OTHER PUBLICATIONS

Chinese Office Action dated Jul. 4, 2008, for Application No. 2006100874576, 7 pages.
European Search Report dated Jul. 7, 2008 for Application No. 06011928.6, 6 pages.

* cited by examiner

*Primary Examiner* — Alexander S Beck
*Assistant Examiner* — Charles Hicks
(74) *Attorney, Agent, or Firm* — Fish & Richardson P.C.

(57) ABSTRACT

A plasma display apparatus and a driving method thereof are provided. The plasma display apparatus and a driving method thereof represent an image by a combination of a plurality of subfields, supply a first pulse to the first electrode in a negative polarity direction before a reset period for initializing in at least one of the plurality of subfields, supply a second pulse to the second electrode in an opposite polarity direction of the first pulse while the first pulse is supplied to the first electrode, and do not supply a sustain pulse to at least one of the first electrode and the second electrode in a sustain period after the reset period.

9 Claims, 11 Drawing Sheets

PLASMA DISPLAY APPARATUS AND DRIVING METHOD THEREOF

This Nonprovisional application claims priority under 35 U.S.C. §119(a) on patent application Ser. No. 10-2006-0021960 filed in Korea on Mar. 8, 2006, the entire contents of which are hereby incorporated by reference.

BACKGROUND OF THE INVENTION

1. Field of the Invention

The present invention relates to a plasma display apparatus and a driving method thereof.

2. Description of the Background Art

In general, a plasma display apparatus comprises a plasma display panel in which a plurality of electrodes is formed and a driver for driving the electrodes of the plasma display panel.

The plasma display panel is formed by coupling of a front panel comprising a front substrate and a rear panel comprising a rear substrate.

A discharge cell is formed between the front substrate and the rear substrate.

The driver supplies a predetermined driving voltage to a discharge cell of the plasma display panel in a plurality of subfields of a frame. Accordingly, a discharge such as a reset discharge, an address discharge, and a sustain discharge is generated within the discharge cell of the plasma display panel by the driving voltage.

When a discharge is generated within the discharge cell with the supply of a predetermined driving voltage, a discharge gas that is filled within the discharge cell generates high frequency light such as vacuum ultraviolet rays.

The high frequency light allows a phosphor that is formed within the discharge cell to emit light and thus a phosphor layer generates visible rays, so that an image is represented.

The plasma display panel is considered as one of the next generation display devices due to its thin profile and light weight construction.

In a conventional plasma display apparatus, gray level of an image using one or more pair of sustain pulses is represented in a sustain period in all subfields of a frame.

Accordingly, gray level, which can be represented in the conventional plasma display apparatus, is only integer gray level such as 1, 2, and 3 gray level.

SUMMARY OF THE INVENTION

Accordingly, the present invention is directed to a plasma display apparatus and method of driving same that substantially obviates one or more of the problems due to limitations and disadvantages of the related art.

In one aspect, there are provided a plasma display apparatus comprising a plasma display panel and a driver and a driving method thereof, wherein the plasma display apparatus and the driving method thereof supply a first pulse to a first electrode in a negative polarity direction before a reset period for initializing in at least one of a plurality of subfields for representing an image; supply a second pulse to a second electrode in an opposite polarity direction of the first pulse while the first pulse is supplied to the first electrode; and do not supply a sustain pulse to at least one of the first electrode and the second electrode in a sustain period after the reset period.

In another aspect, there are provided a plasma display apparatus comprising a plasma display panel and a driver and a driving method thereof, wherein the plasma display apparatus and the driving method thereof supply a first pulse to a first electrode in a negative polarity direction before a reset period for initializing in at least one of a plurality of subfields for representing an image; supply a second pulse to a second electrode in an opposite polarity direction of the first pulse while the first pulse is supplied to the first electrode; and drive by omitting a sustain period for supplying a sustain pulse to the first electrode and the second electrode after the reset period.

Implementations may include one or more of the following features. For example, at least one of the plurality of subfields may be a first subfield in one frame.

At least one of the plurality of subfields may be a low gray level subfield.

The first subfield may be a subfield having a lowest gray level weight among the plurality of subfields.

A voltage of the second pulse may be substantially equal to that of the sustain pulse.

A positive polarity bias voltage may be supplied to the second electrode at approximately a start time point of an address period after the reset period.

A lowest voltage of the first pulse may be equal to or higher than that of a scan pulse that is supplied to the first electrode in an address period after the reset period. It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Example embodiments of the present invention will be described in a more detailed manner with reference to the drawings.

Figure 1:
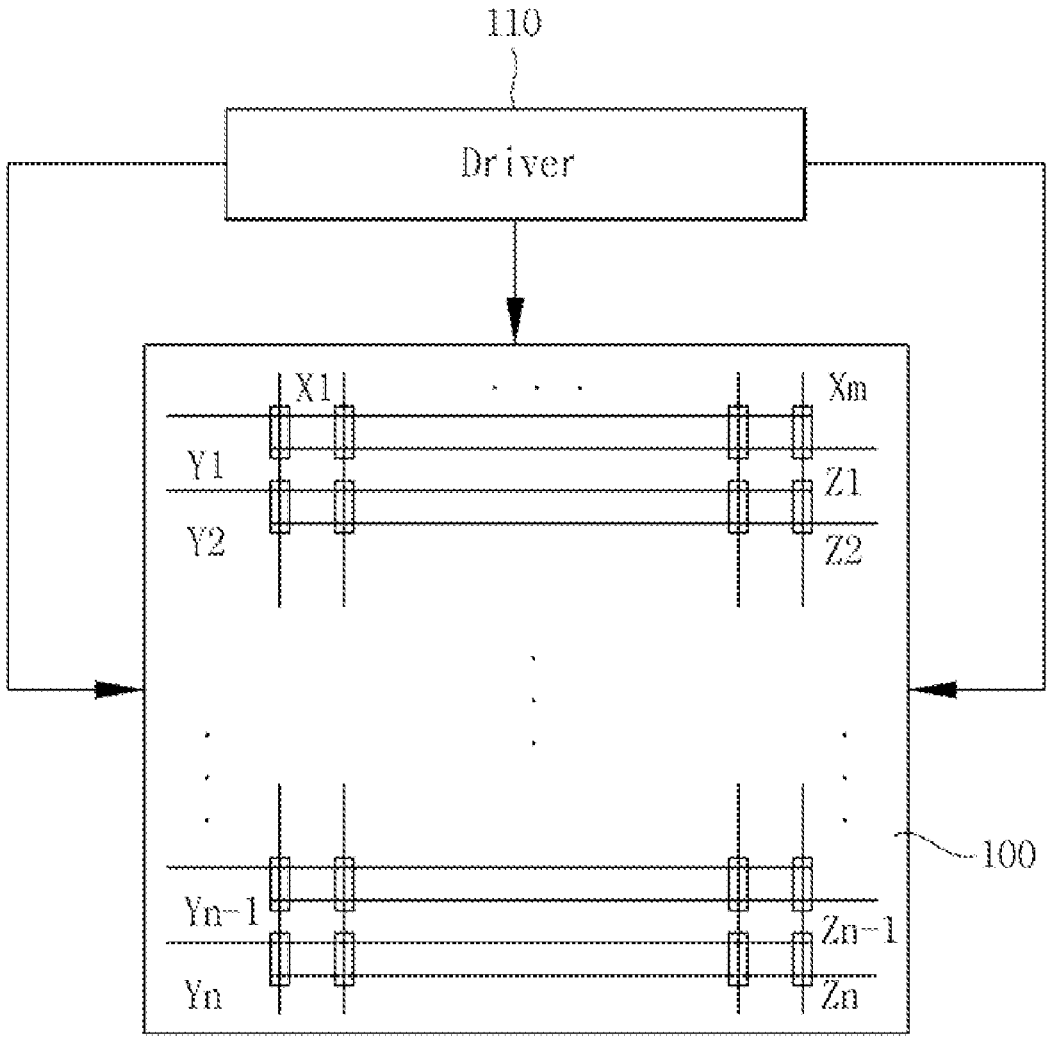
FIG. 1 is a diagram illustrating a configuration of a plasma display apparatus according to the present invention.

FIG. 1 is a diagram illustrating a configuration of a plasma display apparatus according to the present invention.

Referring to FIG. 1, the plasma display apparatus according to the present invention comprises a plasma display panel 100 and a driver 110.

The plasma display panel 100 comprises a first electrode (Y) (e.g., a scan electrode) and a second electrode (Z) (e.g., a sustain electrode). Hereinafter, for convenience of description, the first electrode and the second electrode are referred to as a scan electrode and a sustain electrode, respectively. However, as can be seen from the description to be described later and substantial meaning of claims, it does not always mean that the first electrode is the scan electrode and the second electrode is the sustain electrode, i.e., they may have opposite meaning.

The scan electrode (Y) and the sustain electrode (Z) that are comprised in the plasma display panel are disposed in parallel to each other.

The driver drives electrodes of the plasma display panel 100.

For example, an address electrode (X) can be driven through a method of supplying a data voltage of a data pulse to the address electrode (X) of the plasma display panel 100.

Furthermore, the driver 110 can drive the scan electrode (Y) through a method of supplying a reset voltage, a scan voltage of a scan pulse, and a voltage of a sustain pulse to the scan electrode (Y) of the plasma display panel 100.

Furthermore, the driver 110 can drive the sustain electrode (Z) through a method of supplying a sustain bias voltage and a voltage of a sustain pulse to the sustain electrode (Z) of the plasma display panel 100.

The driver 110, which is a major part of the plasma display apparatus according to the present invention, will become more readily apparent from the detailed description given hereinafter.

The plasma display panel that is comprised in the plasma display apparatus according to the present invention will be described in detail with reference to FIGS. 2A and 2B.

Figure 2A:
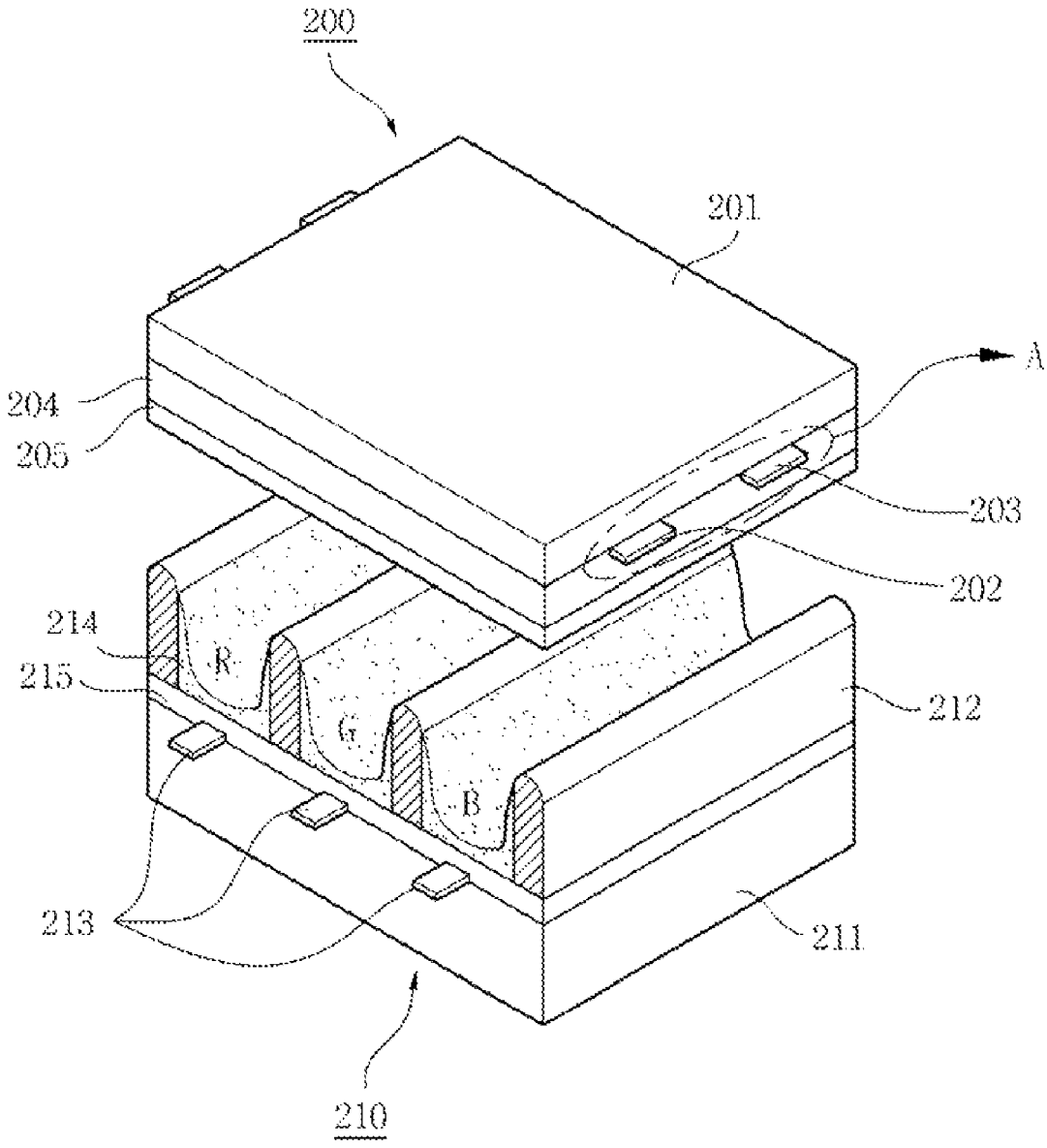
FIGS. 2A and 2B are views illustrating an example of a structure of a plasma display panel that is comprised in the plasma display apparatus according to the present invention.
Figure 2B:
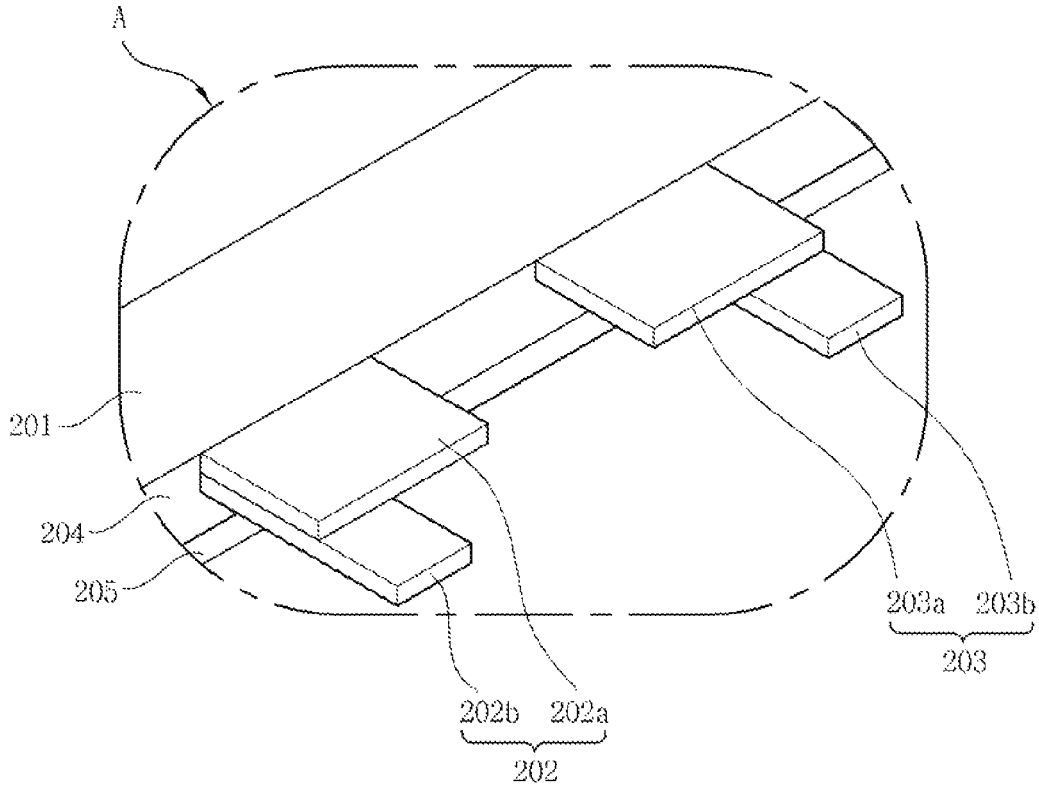

FIGS. 2A and 2B are views illustrating an example of a structure of a plasma display panel that is comprised in the plasma display apparatus according to the present invention.

First, referring to FIG. 2A, in the plasma display panel according to the present invention, a front panel 200 and a rear panel 210 are coupled to each other. The front panel 200 comprises a front substrate 201, which is formed with electrodes, preferably, scan electrodes 202 (Y) and sustain electrodes 203 (Z). The rear panel 210 comprises a rear substrate 211, which is formed with electrodes, preferably, address electrodes 213 (X) that intersects the scan electrodes 202 (Y) and the sustain electrodes 203 (Z).

Electrodes, preferably, the scan electrodes 202 (Y) and the sustain electrodes 203 (Z) that are formed on the front substrate 201 generate a discharge in a discharge space, i.e., a discharge cell and sustain a discharge of the discharge cell.

In an upper part of the front substrate 201 that is formed with the scan electrodes 202 (Y) and the sustain electrodes 203 (Z), a dielectric layer, preferably, an upper dielectric layer 204 is form to cover the scan electrodes 202 (Y) and the sustain electrodes 203 (Z).

The upper dielectric layer 204 limits a discharge current of the scan electrode 202 (Y) and the sustain electrode 203 (Z) and provides isolation between the scan electrode 202 (Y) and the sustain electrode 203 (Z).

A protective layer 205 is formed on an upper surface of the upper dielectric layer 204 to facilitate discharge conditions. The protective layer 205 is formed through a method of depositing with a material such as magnesium oxide (MgO) in an upper part of the upper dielectric layer 204.

On the other hand, electrodes, preferably, the address electrodes 213 (X), which are formed on the rear substrate 211, supply data to the discharge cell.

In an upper part of the rear substrate 211 that is formed with the address electrodes 213 (X), a dielectric layer, preferably, a lower dielectric layer 215 is form to cover the address electrodes 213 (X).

The lower dielectric layer 215 provides isolation to the address electrode 213 (X).

In an upper part of the lower dielectric layer 215, barrier ribs 212 for partitioning a discharge space, i.e., a discharge cell are formed in a stripe type. In FIGS. 2A and 2B, a stripe type barrier rib is shown, but a well type, a delta type, or other deformable barrier ribs may be used. Accordingly, a plurality of discharge cells is formed between the front substrate 201 and the rear substrate 211.

A discharge cell that is partitioned by the barrier ribs 212 is filled with a predetermined discharge gas.

Furthermore, phosphor layers 214, for example, red color (R), green color (G), and blue color (B) phosphor layers that emit visible light for displaying an image upon performing an address discharge are formed within the discharge cells that are partitioned by the barrier ribs 212.

In the plasma display panel described above, when a driving voltage is supplied to at least one of the scan electrode 202 (Y), the sustain electrode 203 (Z), and the address electrode 213 (X), a discharge is generated within a discharge cell that is partitioned by the barrier ribs 212.

Thereafter, vacuum ultraviolet rays are generated in a discharge gas filled within the discharge cell and applied to the phosphor layer 214 that is formed within the discharge cell. Thereafter, predetermined visible rays are generated in the phosphor layer 214, and the generated visible rays emit to the outside through the front substrate 201 in which the upper dielectric layer 204 is formed. Accordingly, a predetermined image is displayed on an outside surface of the front substrate 201.

In the description of FIG. 2A, only a case where each of the scan electrode 202 (Y) and the sustain electrode 203 (Z) is formed in one layer is described, but at least one of the scan electrode 202 (Y) and the sustain electrode 203 (Z) may be formed in a plurality of layers. This will be described with reference to FIG. 2B.

Referring to FIG. 2B, each of the scan electrode 202 (Y) and the sustain electrode 203 (Z) may be formed in two layers.

Specifically, in view of light transmittance and electrical conductivity, it is preferable that the scan electrode 202 (Y) and the sustain electrode 203 (Z) comprise bus electrodes 202*b* and 203*b* of an opaque silver (Ag) material and transparent electrodes 202*a* and 203*a* of a transparent indium tin oxide (ITO) material in order to emit light that is generated within the discharge cell to the outside and secure driving efficiency.

The reason why the scan electrode 202 (Y) and the sustain electrode 203 (Z) are formed to comprise the transparent electrodes 202*a* and 203*a* is to effectively emit visible light that is generated within the discharge cell to the outside of the plasma display panel.

Furthermore, the reason why the scan electrode 202 (Y) and the sustain electrode 203 (Z) are formed to comprise the bus electrodes 202*b* and 203*b* is that when the scan electrode 202 (Y) and the sustain electrode 203 (Z) comprise only the transparent electrodes 202*a* and 203*a*, low electrical conductivity of the transparent electrodes 202*a* and 203*a* in which driving efficiency thereof may be decreased due to relatively low electrical conductivity of the transparent electrodes 202*a* and 203*a* can be compensated.

FIGS. 2A and 2B show only an example of the plasma display panel according to the present invention, but the present invention is not limited to the plasma display panel having a structure as in FIGS. 2A and 2B. For example, although only a case where each of the upper dielectric layer 204 and the lower dielectric layer 215 is formed in one layer is shown in the plasma display panel of FIGS. 2A and 2B, at least one of the upper dielectric layer 204 and the lower dielectric layer 215 may be formed in a plurality of layers.

Next, an operation of the driver 110 in the plasma display apparatus is as follows.

The driver 110 represents an image on a screen of the plasma display panel 100 by driving the plasma display panel 100 having the above-mentioned structure with a frame consisting of a plurality of subfields.

An operation of the driver 110 will be described with reference to FIGS. 3, 4A, and 4B.

Figure 3:
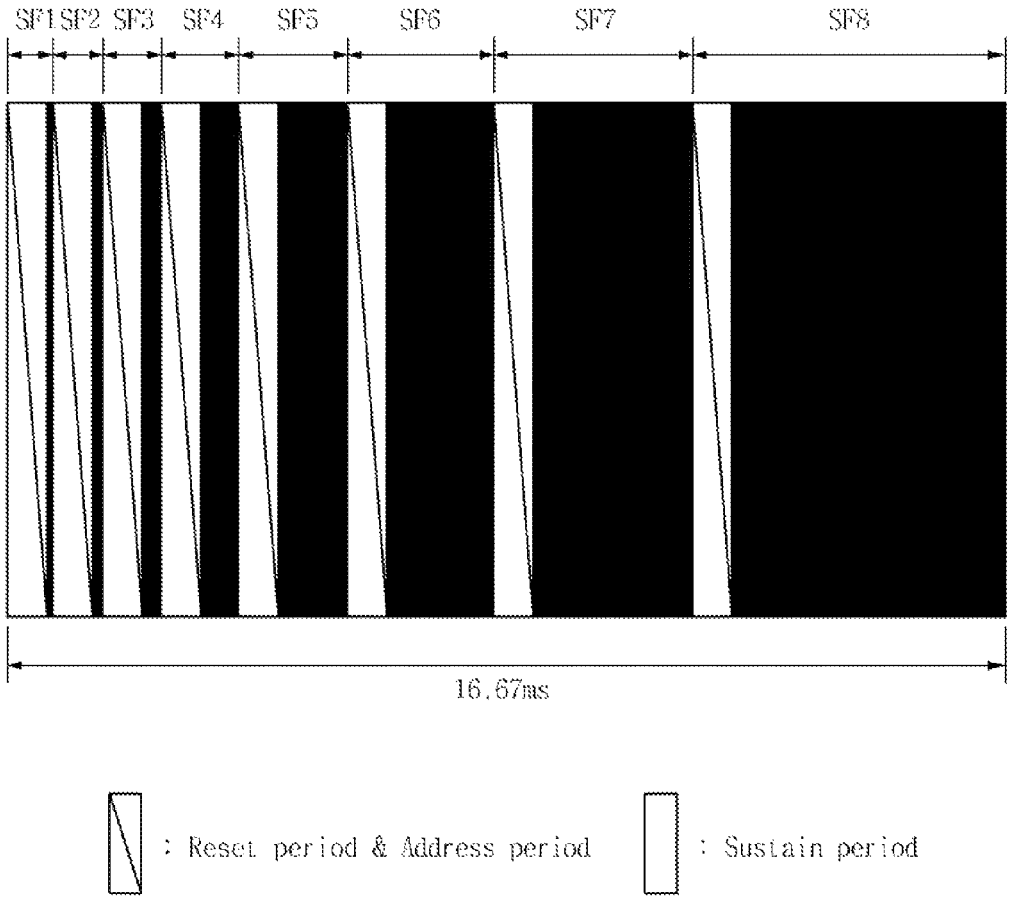
FIG. 3 is a diagram illustrating a frame for representing gray level of an image in the plasma display apparatus according to the present invention.

FIG. 3 is a diagram illustrating a frame for representing gray level of an image in the plasma display apparatus according to the present invention.

Figure 4A:
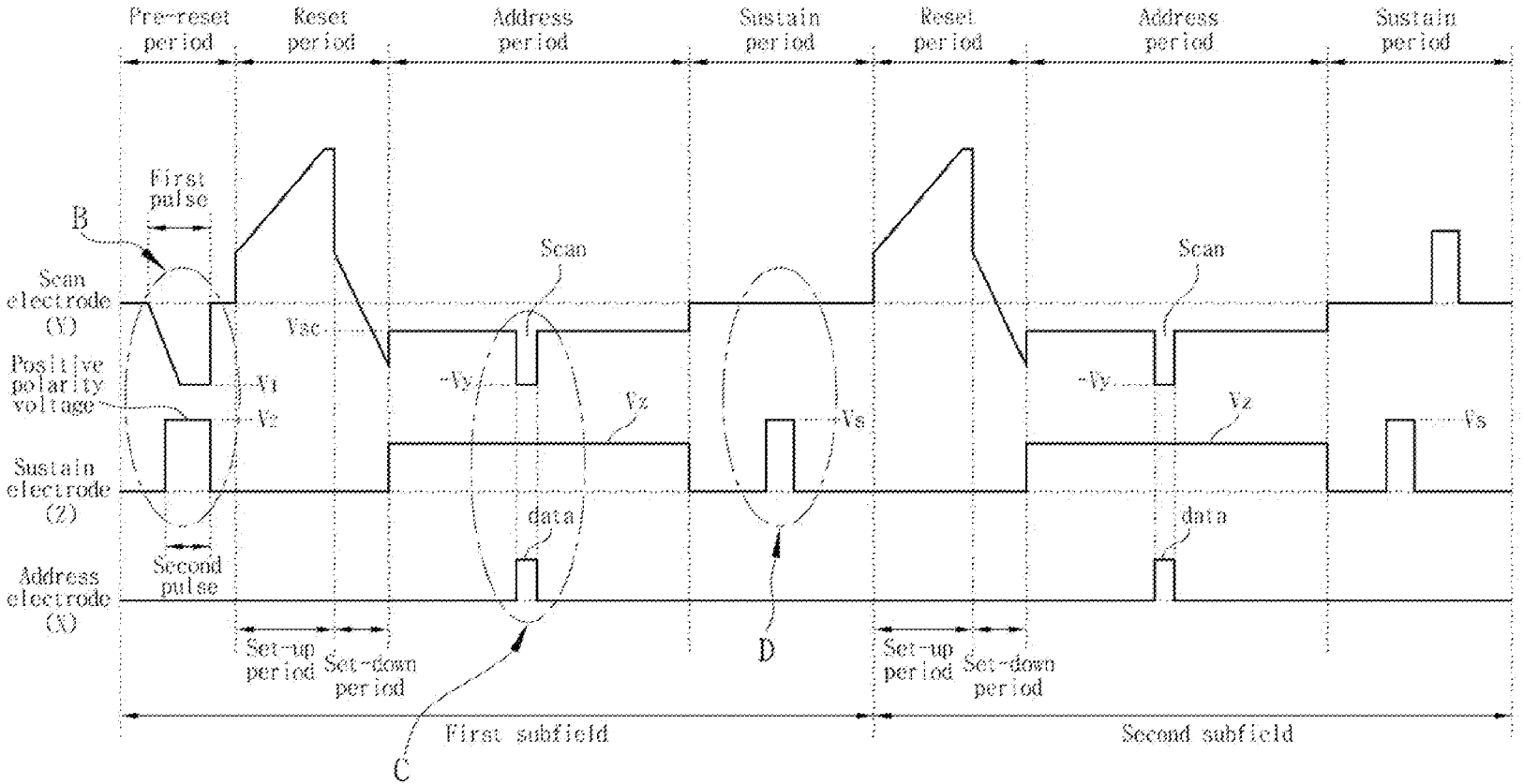
FIGS. 4A and 4B are diagrams illustrating an example of an operation of a driver of the plasma display apparatus according to the present invention.
Figure 4B:
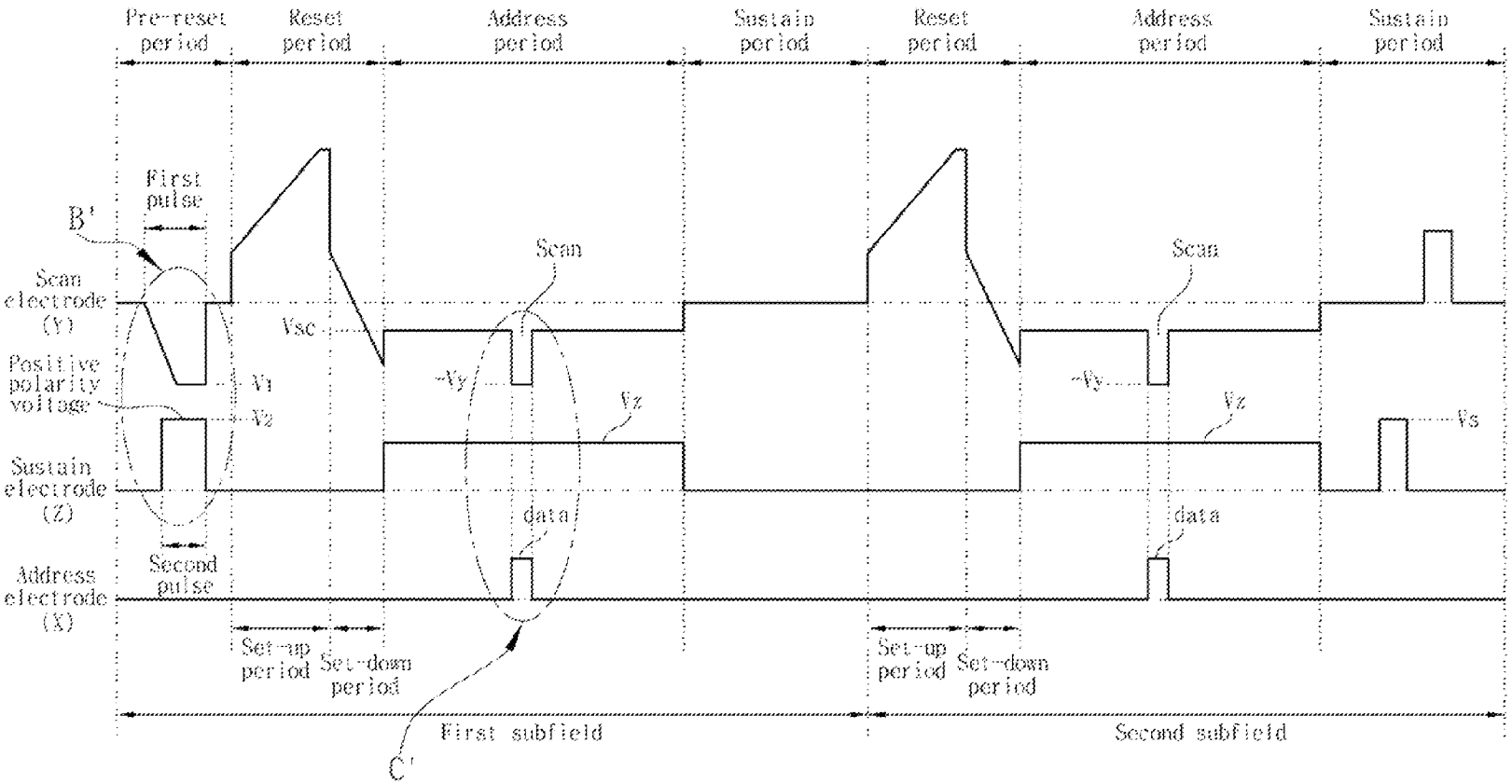

Furthermore, FIGS. 4A and 4B are diagrams illustrating an example of an operation of a driver of the plasma display apparatus according to the present invention.

First, referring to FIG. 3, in the plasma display apparatus according to the present invention, a frame for representing gray level of an image is divided into several other subfields having the different number of light emitting. Furthermore, although not shown, each subfield is again divided into a reset period for initializing all discharge cells, an address period for selecting the discharge cell to be discharged, and a sustain period for representing gray level depending on the number of discharges.

For example, when the image is represented with 256-level gray levels, as shown in FIG. 3, a frame period (16.67 ms) corresponding to 1/60 second is divided into, for example, eight subfields (SF1 to SF8), and each of the eight subfields (SF1 to SF8) is again divided into the reset period, the address period, and the sustain period.

The duration of the reset period in a subfield is equal to the duration of the reset periods in the remaining subfields. The duration of the address period in a subfield is equal to the duration of the address periods in the remaining subfields.

On the other hand, a gray level weight of a corresponding subfield can be set by adjusting the number of the sustain pulses that are supplied in a sustain period. That is, a predetermined gray level weight can be provided in each subfield using the sustain period. For example, a gray level weight of each subfield can be determined so that a gray level weight of each subfield increases in a ratio of $2^n$ (n=0, 1, 2, 3, 4, 5, 6, 7) by a method of setting gray level weights of the first subfield and the second subfield to $2^0$ and $2^1$, respectively. Gray level of various images is represented by adjusting the number of the sustain pulses that are supplied in a sustain period of each subfield depending on a gray level weight in each subfield.

The plasma display apparatus according to the present invention uses a plurality of frames in order to display an image of one second. For example, 60 frames are used in order to display an image of one second.

In FIG. 3, although a case where one frame is composed of 8 subfields is described, the number of subfields constituting one frame can be variously changed. For example, one frame may be composed of 12 subfields of the first subfield to twelfth subfields and one frame may be composed of 10 subfields.

Picture quality of an image represented by a plasma display apparatus for representing gray level of an image with the frame can be determined depending on the number of the subfields that are comprised in the frame. That is, when the number of the subfields that are comprised in the frame is 12, gray level of $2^{12}$ can be represented and when the number of the subfields that are comprised in the frame is 8, gray level of $2^8$ can be represented.

Furthermore, in FIG. 3, subfields are arranged in the increasing order of a gray level weight in one frame, but subfields may be arranged in the decreasing order of a gray level weight in one frame or subfields may be arranged regardless of a gray level weight.

Next, in FIGS. 4A and 4B, an example of an operation of a driver in a predetermined subfield of a plurality of subfields that are comprised in the frame of FIG. 3 is shown.

First, referring to FIG. 4A, a driver 110 of the plasma display apparatus in FIG. 1 supplies a first pulse to a scan electrode (Y) of the plasma display panel 100 in a negative polarity direction before a reset period for initializing in any subfield of a plurality of subfields in a frame for representing an image, i.e., at least one of the plurality of subfields, supplies a second pulse to a sustain electrode (Z) in an opposite polarity direction of the first pulse during a period when the first pulse is supplied, and supplies a sustain pulse to only one of the scan electrode (Y) and the sustain electrode (Z) in a sustain period.

In this case, the first pulse and the second pulse may be any type of pulse. However, it is preferable that the first pulse may comprise a pulse having a gradually falling slope in a negative polarity direction and the second pulse may have a shape of a square wave.

At least one of a plurality of subfields may be a first subfield depending on the time order among a plurality of subfields constituting one frame.

Furthermore, at least one of the plurality of subfields may be any subfield regardless of a gray level weight, but it may be preferably a low gray level subfield having a low gray level weight.

In this case, a gray level weight may be the number of sustain pulses that are applied by being allocated to a sustain period of one subfield, be the number of sustain pulses that are applied in sustain periods of several subfields, or be a brightness amount depending on a light emitting amount that is generated in one subfield period.

The second pulse that is supplied to the sustain electrode (Z) rises to the second voltage (V2) and the second voltage is preferably approximately equal to a voltage (Vs) of a sustain pulse that is supplied to the sustain electrode (Z) in a sustain period.

Furthermore, it is preferable that a lowest voltage (V1) of the first pulse that is supplied to the scan electrode (Y) is equal to or higher than a lowest voltage of a voltage (−Vy) of a scan pulse that is supplied to the scan electrode (Y) in an address period after a reset period.

The reason why a lowest voltage of the first pulse is set to be equal to a lowest voltage of a scan pulse is to reduce a production cost by using the same voltage source without a new voltage source. The reason why a lowest voltage of the first pulse is set to be higher than a lowest voltage of a scan pulse is to secure a voltage driving margin by reducing a maximum voltage value of a gradually rising ramp pulse applied to a scan electrode.

As the first pulse and the second pulse are supplied to the scan electrode and the sustain electrode, respectively before the reset period, positive polarity (+) wall charges are accumulated on the scan electrode (Y) in the discharge cell and negative polarity (−) wall charges are accumulated on the sustain electrode (Z).

Accordingly, a state of the wall charge that can more easily generate a reset discharge in the reset period is formed within the discharge cell.

In a set-up period of the reset period, a ramp-up waveform with a gradually rising voltage can be supplied to the scan electrode (Y).

A weak dark discharge, i.e., a set-up discharge is generated within the discharge cell by the ramp-up waveform. By performing the set-up discharge, somewhat wall charges are accumulated within the discharge cell.

Furthermore, in a set-down period after the set-up period, after a ramp-up waveform is supplied to the scan electrode (Y), a ramp-down waveform with a gradually falling voltage from a predetermined positive polarity voltage that is lower than a peak voltage of the ramp-up waveform can be supplied.

Accordingly, a weak erasing discharge, i.e., a set-down discharge is generated in the discharge cell. By performing the set-down discharge, a part of wall charges that are accumulated within the discharge cells by the previous set-up discharge is erased and the wall charges uniformly remain within the discharge cells to the degree that there is the generation of a stable address discharge.

A scan reference voltage (Vsc) and a voltage (−Vy) of a negative polarity scan pulse (Scan) that falls from the scan reference voltage (Vsc) can be supplied to the scan electrode (Y) in an address period after the reset period comprising the set-up period and the set-down period.

Furthermore, when a voltage (−Vy) of a negative polarity scan pulse is supplied to the scan electrode (Y), a voltage (Vd) of a data pulse is supplied to the address electrode (X) to correspond thereto.

Furthermore, a sustain bias voltage (Vz) can be supplied to the sustain electrode (Z) in the address period so as to prevent an erroneous discharge from generating due to interference of the sustain electrode (Z) in the address period.

In this case, a sustain bias voltage is a positive polarity voltage and may be supplied to a sustain electrode at approximately a start time point of an address period. Specifically, a positive polarity bias voltage (Vzb) can be applied between an end time point of a set-down period of a reset period and an applying time point of a first scan pulse that is applied to scan electrodes.

The reason why a positive polarity Z bias voltage (Vzb) is applied at an end time point of a set-down period of a reset period is to reduce a potential difference between scan electrodes (Y) and sustain electrodes (Z) in a set-down period of a reset period. Accordingly, a surface discharge is suppressed from generating and thus contrast characteristics are improved. Furthermore, the reason why a positive polarity Z bias voltage (Vzb) is applied within an applying time point of a first scan pulse that is applied to the scan electrodes (Y) is to do not have an influence on an address discharge that is generated in an address period. That is, this is to improve jitter characteristics in an address period. Accordingly, a driving margin can be secured by reducing a width of scan pulses that are applied to the scan electrodes (Y) in an address period.

In the address period, while the voltage difference between a voltage (−Vy) of the negative polarity scan pulse and a voltage (Vd) of the data pulse is added to a wall voltage by wall charges generated in the reset period, an address discharge is generated within a discharge cell to which a voltage (Vd) of a data pulse is supplied.

The wall charges necessary for a discharge when a sustain voltage (Vs) of a sustain pulse is supplied are formed within the discharge cells selected by performing the address discharge.

In a sustain period after the address period, the driver 110 shown in FIG. 1 allows a sustain pulse to be not supplied to any one of the scan electrode (Y) and the sustain electrode (Z).

When a sustain pulse is supplied to the sustain electrode (Z), a sustain discharge, i.e., a display discharge is generated between the scan electrode (Y) and the sustain electrode (Z) while a wall voltage within the discharge cell that is selected by an address discharge is added to a voltage of a sustain pulse (SUS).

Accordingly, light generated by a discharge generating between the scan electrode (Y) and the sustain electrode (Z) by the first pulse and the second pulse in an area B of a low gray level subfield, i.e., a first subfield, light generated by a discharge generating between the scan pulse and the sustain pulse in a C area, and light generated by the sustain pulse that is supplied to the sustain electrode (Z) in a D area are combined, so that gray level of an image is represented.

If is assumed that light represented by a pair of sustain pulses is in 1 gray level, light represented by a sustain pulse that is supplied to one of the sustain electrodes (Z) may be in 0.5 gray level as in FIG. 4A.

Furthermore, in a pre-reset period, gray level of light generating by the first pulse and the second pulse that are supplied to the scan electrode (Y) is relatively smaller than gray level of light that is represented by the sustain pulse. Light generating in the pre-reset period may be in 0.1 gray level.

Furthermore, an address discharge generating between the scan pulse and the data pulse in the address period generates between the scan electrode (Y) and the address electrode (X) within a discharge cell. Gray level of light generating by the address discharge is relatively smaller than gray level of light that is represented by the sustain pulse. Light generating in the address period may be in 0.2 gray level.

Accordingly, light of total 0.8 gray level can be represented in a low gray level subfield as in FIG. 4A, i.e., the first subfield. Accordingly, more minute gray level can be represented, compared to the prior art that supplies one or more pair of sustain pulses in all subfields.

In the low gray level subfield, only a sustain pulse is supplied to any one electrode of the scan electrode and the sustain electrode. However, when a pair of sustain pulses is supplied several times to the scan electrode and the sustain electrode in a sustain period in a high gray level subfield having a high weight, minute gray level can be represented by supplying one sustain pulse to any one electrode.

In a second subfield that is comprised after a low gray level subfield, i.e., the first subfield in which a sustain pulse is supplied to only any one electrode of the scan electrode (Y) and the sustain electrode (Z), a pre-reset period is not comprised in a period before a reset period and a sustain pulse is supplied to both of the scan electrode (Y) and the sustain electrode (Z) in a sustain period.

In FIG. 4A, the sustain pulse is supplied to only any one of the scan electrode (Y) and the sustain electrode (Z) in the sustain period, but representing power of gray level can be improved by allowing the sustain pulse to be not supplied to both of the scan electrode (Y) and the sustain electrode (Z) in the sustain period. This will be described with reference to FIG. 4B. In FIG. 4B, duplicate descriptions of FIG. 4A will be omitted.

Referring to FIG. 4B, the driver 110 allows a sustain pulse to be not supplied to both of the scan electrode (Y) and the sustain electrode (Z) in a sustain period after an address period.

Accordingly, light generated by a discharge generating between the scan electrode (Y) and the sustain electrode (Z) by a falling pulse and a positive polarity voltage in an area B of the low gray level subfield of FIG. 4B, i.e., the first subfield and light generated by a discharge generating between the scan pulse and the sustain pulse in a C' area are combined, so that gray level of an image is represented.

As described above, light generating in the pre-reset period may be in 0.1 gray level and light generating in the address period may be in 0.2 gray level.

Accordingly, light of total 0.3 gray level can be represented in a low gray level subfield as in FIG. 4B, i.e., the first subfield. Accordingly, more minute gray level can be represented, compared to the prior art that supplies one or more pair of sustain pulses in all subfields.

On the other hand, in FIG. 4A and FIG. 4B, a low gray level subfield is set so that a process of supplying a sustain pulse to any one of the scan electrode (Y) and the sustain electrode (Z) in the sustain period or a process of supplying the sustain pulse to both of the scan electrode (Y) and the sustain electrode (Z) is omitted, but a low gray level subfield may be set not to comprise the sustain period.

This will be described with reference to FIG. 5.

Figure 5:
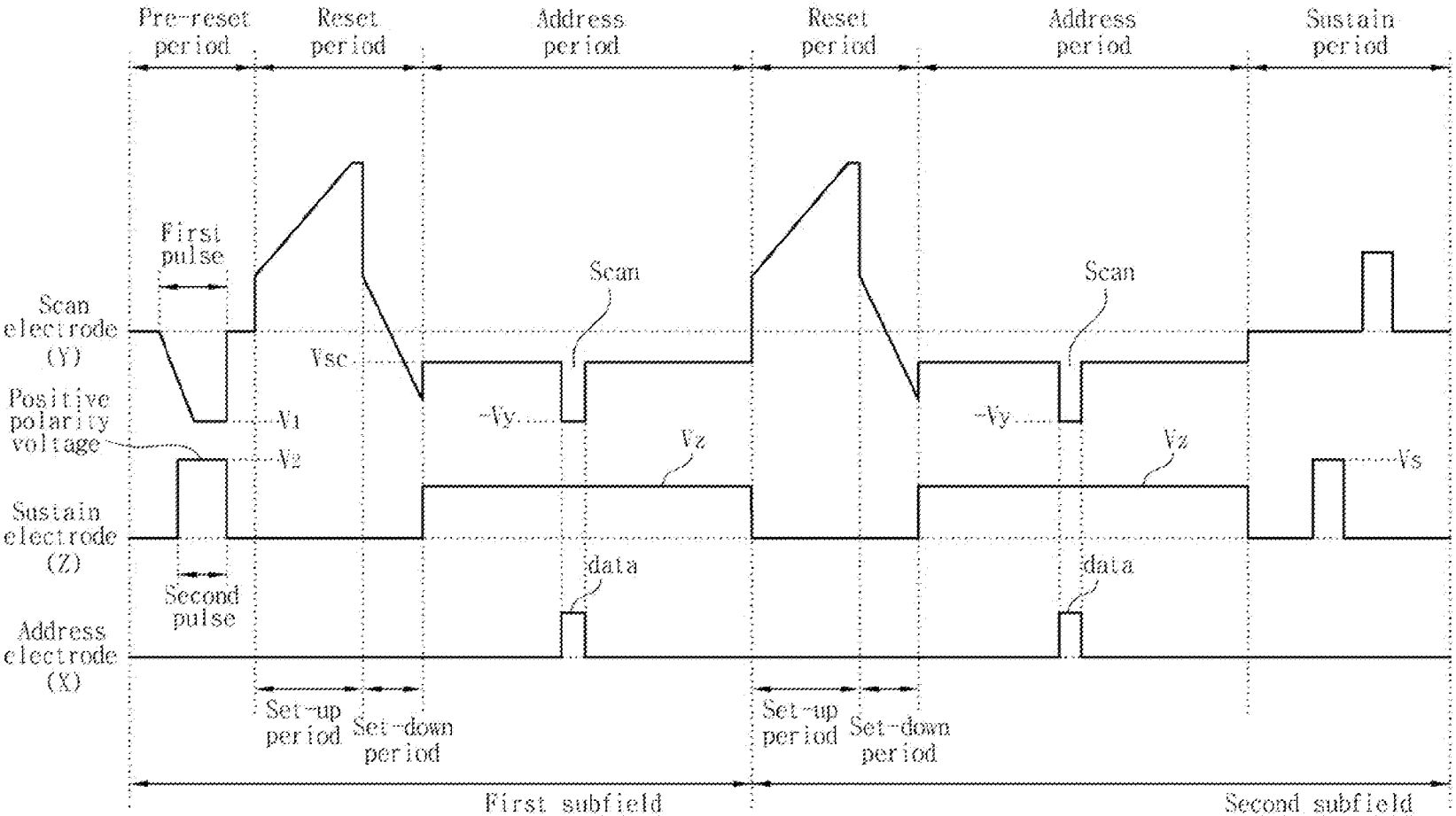
FIG. 5 is a diagram illustrating another example of an operation of the driver of the plasma display apparatus according to the present invention.

FIG. 5 is a diagram illustrating another example of an operation of the driver of the plasma display apparatus according to the present invention. In FIG. 5, duplicate descriptions of FIGS. 4A and 4B will be omitted.

Referring to FIG. 5, a driver 110 of the plasma display apparatus in FIG. 1 supplies a first pulse to the scan electrode (Y) in a negative polarity direction before a reset period for initializing in any subfield of a plurality of subfields of a frame for representing an image, i.e., at least one subfield of a plurality of subfields, supplies a second pulse to the sustain electrode (Z) while the first pulse is supplied, and omits a sustain period for supplying the sustain pulse after a reset period. FIG. 5 is substantially equal to FIG. 4B. However, the sustain period is comprised in FIG. 4B and the sustain period is omitted in FIG. 5. That is, no voltage is applied to the first electrode and the second electrode after an address period.

A pulse of a sustain voltage level is alternately applied to the first electrode and the second electrode in other subfields except subfields in which a sustain period is omitted.

Figure 7:
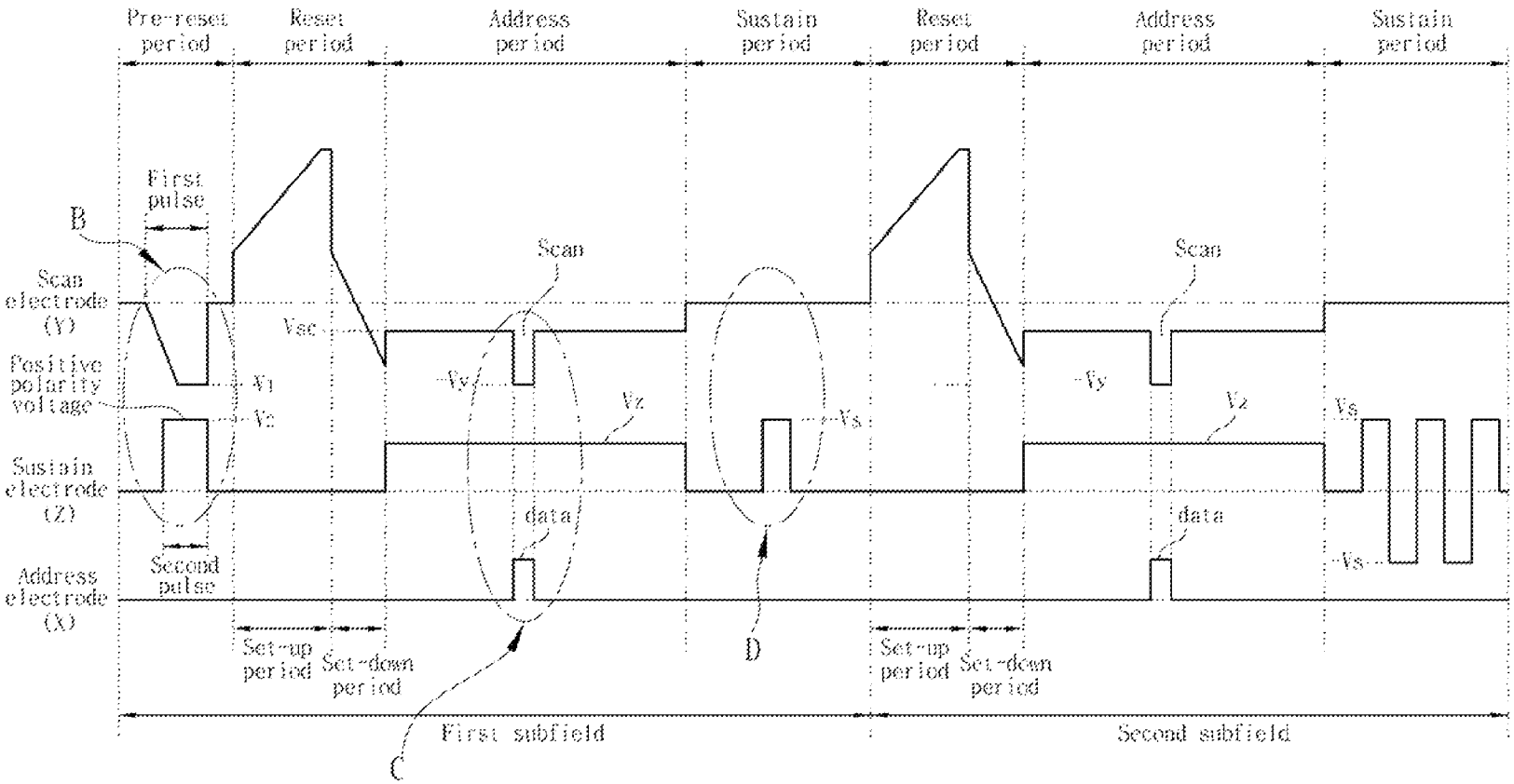
FIGS. 7 to 9 diagrams illustrating other examples of a driving pulse that is applied to a scan electrode and a sustain electrode in a sustain period of FIG. 4A.
Figure 8:
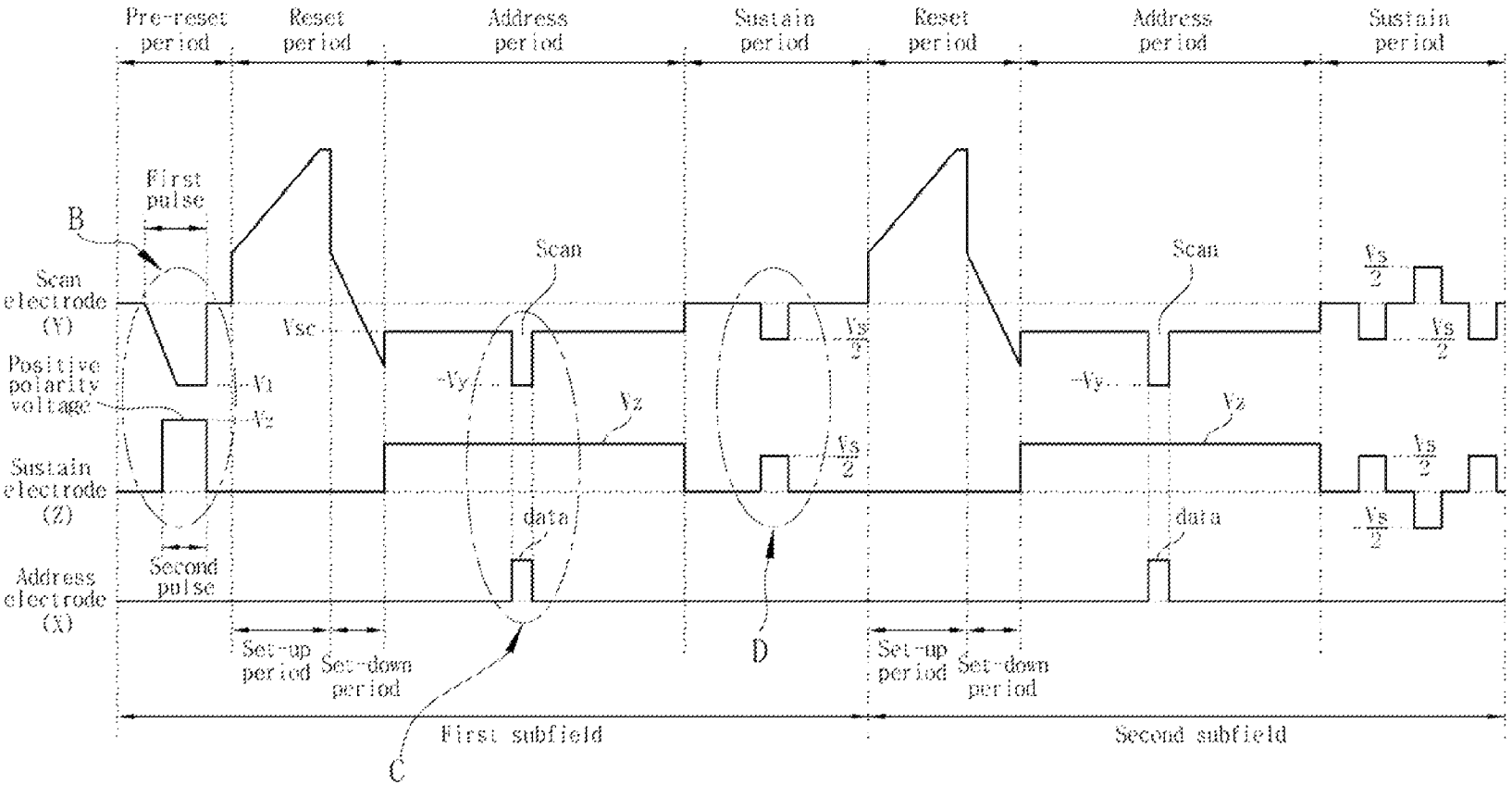
Figure 9:
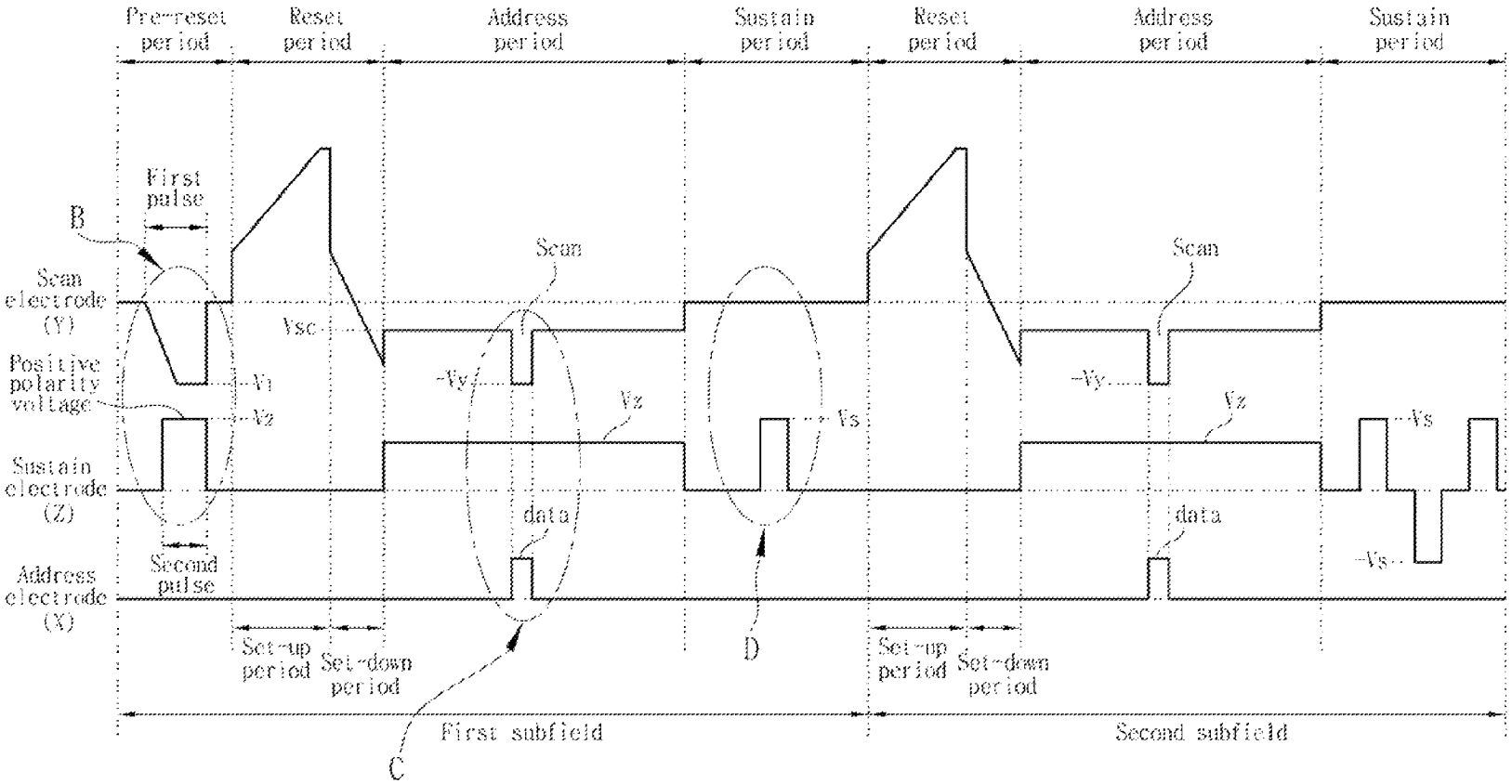

FIGS. 7 to 9 diagrams illustrating another example of a driving pulse that is applied to a scan electrode and a sustain electrode in a sustain period of FIG. 4A.

First, referring to FIG. 7, a driver 110 of a plasma display apparatus in FIG. 1 supplies a sustain pulse to only one electrode of a scan electrode and a sustain electrode in a sustain period of at least one subfield (e.g., a first subfield of a frame) of a plurality of subfields.

Furthermore, a sustain pulse of a positive polarity voltage (Vs) and a sustain pulse of a negative polarity voltage (−Vs) are alternately applied to a sustain electrode and a predetermined bias voltage is applied to a scan electrode during a sustain period of other subfields except at least one subfield of the plurality of subfields.

In FIG. 7, during a sustain period, a sustain pulse of a positive polarity voltage and a sustain pulse of a negative polarity voltage are alternately applied to a sustain electrode and a predetermined bias voltage is applied to a scan electrode. However, in contrast, a predetermined bias voltage may be applied to the sustain electrode and a sustain pulse of a positive polarity voltage and a sustain pulse of a negative polarity voltage may be alternately applied to the scan electrode.

In this case, a predetermined bias voltage is preferably a ground level.

Referring to FIG. 8, a driver 110 of a plasma display apparatus in FIG. 1 applies one negative polarity pulse to a scan electrode and one positive polarity pulse to a sustain electrode during a sustain period of at least one subfield (e.g., a first subfield of a frame) of a plurality of subfields. In this case, the potential difference between a negative polarity pulse and a positive polarity pulse is a sustain voltage (Vs) that may cause a sustain discharge.

Furthermore, a plurality of negative polarity pulses are applied to a scan electrode and a plurality of positive polarity pulses are applied to a sustain electrode during a sustain period of other subfields except at least one subfield of the plurality of subfields.

Referring to FIG. 9, a driver 110 of a plasma display apparatus in FIG. 1 supplies a sustain pulse to only one electrode of a scan electrode and a sustain electrode in a sustain period of at least one subfield (e.g., a first subfield of a frame) of a plurality of subfields.

Furthermore, a predetermined bias voltage is applied to a scan electrode and a sustain pulse of a positive polarity voltage (Vs) and a sustain pulse of a negative polarity voltage (−Vs) are alternately applied to a sustain electrode during a sustain period of other subfields except at least one subfield of the plurality of subfields. In this case, a sustain pulse of a negative polarity voltage (−Vs) is applied after sustaining a bias voltage (e.g., a ground level) during a fixed period after a sustain pulse of a positive polarity voltage (Vs) is applied to the sustain electrode.

Furthermore, similarly to FIG. 7, during a sustain period, a sustain pulse of a negative polarity voltage is applied after sustaining a bias voltage during a fixed period after a sustain pulse of a positive polarity voltage applied to a sustain electrode and a predetermined bias voltage is applied to a scan electrodes. However, in contrast, a sustain pulse of a negative polarity voltage may be applied after sustaining a bias voltage during a fixed period after a predetermined bias voltage is applied to the sustain electrode and a sustain pulse of a positive polarity voltage is applied to the scan electrode.

As described above, a driving pulse that is applied to a scan electrode or a sustain electrode in a sustain period in FIGS. 7 to 9 can be applied to a driving method of a plasma display apparatus of FIG. 4A and can be applied to a driving method of a plasma display apparatus of FIGS. 4B and 5*a*.

As described above, in the sustain period, the sustain pulse is not supplied to the scan electrode (Y) and the sustain electrode (Z) or the sustain pulse is not supplied to any one of the scan electrode (Y) and the sustain electrode (Z), or at least one subfield that does not comprise the sustain period can be comprised in one frame. This will be described with reference to FIG. 6.

Figure 6:
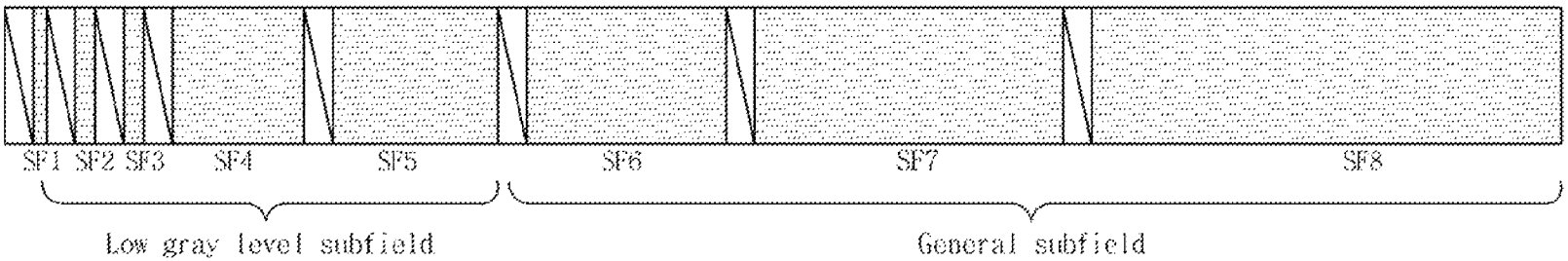
FIG. 6 is a diagram illustrating a method of setting a low gray level subfield within a frame.

FIG. 6 is a diagram illustrating a method of setting a low gray level subfield within a frame.

Referring to FIG. 6, it is preferable that the low gray level subfield is at least one among subfields from a subfield having a lowest gray level weight to a fifth subfield in the increasing order of a gray level weight among a plurality of subfields of a frame.

For example, when one frame is composed of total 8 subfields, i.e., a first, second, third, fourth, fifth, sixth, seventh, and eighth subfields, at least one of five subfields, i.e., the first, second, third, fourth, and fifth subfields having a low gray level weight among the 8 subfields may be a low gray level subfield.

The remaining subfields, i.e., the sixth, seventh, and eighth subfields are general subfields, not a low gray level subfield.

In view of a total driving time and brightness of an image, it is more preferable that a low gray level subfield is a subfield having a lowest gray level weight among the plurality of subfields of a frame.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising a first electrode and a second electrode; and a driver for supplying a first pulse having a negative polarity to the first electrode during a pre-reset period before a reset period of a first subfield among a plurality of subfields for representing an image, and supplying a second pulse having a positive polarity to the second electrode while the first pulse is supplied to the first electrode, supplying a sustain pulse to the second electrode in a sustain period after the reset period of the first subfield, and supplying a ground level voltage to the first electrode throughout the sustain period of the first subfield, wherein a grey level of light generated during an address period of the first subfield is twice as high as a grey level of light generated by the first and second pulses supplied during the pre-reset period before the reset period of the first subfield, and wherein a grey level of light generated during the sustain period is five times as high as a grey level of light generated by the first and second pulses supplied during the pre-reset period before the reset period of the first subfield.

2. The plasma display apparatus of claim 1, wherein the first subfield is a low gray level subfield having a low brightness weight.

3. The plasma display apparatus of claim 2, wherein the low gray level subfield is one of five subfields having lowest brightness weights among the plurality of subfields.

4. The plasma display apparatus of claim 2, wherein the low gray level subfield is a subfield having a lowest brightness weight among the plurality of subfields.

5. The plasma display apparatus of claim 1, wherein a voltage of the second pulse is substantially equal to that of the sustain pulse.

6. The plasma display apparatus of claim 1, wherein a positive polarity bias voltage is supplied to the second electrode at approximately a start time point of an address period after the reset period.

7. The plasma display apparatus of claim 1, wherein a lowest voltage of the first pulse is equal to or higher than a lowest voltage of a scan pulse that is supplied to the first electrode in an address period after the reset period.

8. The plasma display apparatus of claim 1, wherein a grey level of light generated during an address period of the first subfield is at least twice as high as a grey level of light generated by the first and second pulses supplied during the pre-reset period before the reset period of the first subfield.

9. The plasma display apparatus of claim 1, wherein a grey level of light generated during the sustain period is at least five times as high as a grey level of light generated by the first and second pulses supplied during the pre-reset period before the reset period of the first subfield.

* * * * *